United States Patent [19]

Zarate

[11] Patent Number: 5,072,937

[45] Date of Patent: Dec. 17, 1991

[54] BASEBALL BATTING PRACTICE DEVICE

[75] Inventor: Rene A. Zarate, Alice, Tex.

[73] Assignee: South Texas Sports Manufacturing, Inc., Alice, Tex.

[21] Appl. No.: 640,154

[22] Filed: Jan. 11, 1991

[51] Int. Cl.[5] ..... A63B 69/00

[52] U.S. Cl. ..... 273/26 E; 273/58 C; 273/413

[58] Field of Search ..... 273/26 R, 26 A, 29 A, 273/26 E, 26 EA, 184 B, 185 C, 185 D, 208, 58 C, 413

[56] References Cited

U.S. PATENT DOCUMENTS

| | | | |
|---|---|---|---|
| 708,573 | 9/1902 | Miles | 273/29 A |
| 1,105,329 | 7/1914 | Kleinschmidt | 273/26 E |
| 2,247,072 | 6/1941 | Stow | 273/29 A |
| 2,839,300 | 6/1958 | Blaha et al. | 273/26 E |
| 3,475,026 | 10/1969 | Cooper | 273/26 R |
| 4,138,107 | 2/1979 | Janis | 273/29 A |
| 4,735,413 | 4/1988 | Yamanouchi et al. | 273/29 A |

*Primary Examiner*—Theatrice Brown

*Attorney, Agent, or Firm*—G. Turner Moller

[57] ABSTRACT

A baseball batting practice device includes a baseball suspended between horizontal supports by an elongate vertically extending elastic tension member. A mechanism is provided so a coach or player may vertically move the baseball immediately prior to the batter swinging. This mechanism includes a handle for stressing the elongate tension member and moving the baseball. When the tension in the elongate tension member is released, the baseball moves toward its target position. A stop member limits movement of the baseball. The target position of the baseball can be adjusted by moving the stop member.

12 Claims, 2 Drawing Sheets

BASEBALL BATTING PRACTICE DEVICE

This invention relates to a baseball batting practice device and, more particularly, to a device in which a coach or other person can partially control the position of the ball.

Baseball batting practice devices of various type are well known in the art. The simplest type is known as a T-ball which is basically an upstanding resilient support on which a baseball is placed. The batter simply swings at it. At the other end of a range of cost and complexity is a pitching machine which throws baseballs toward the plate and the batter swings at them as they go by.

A number of baseball batting practice devices are of intermediate cost and complexity. One of these types suspends a ball between horizontal supports by use of a more-or-less elastic tensile vertical member. When the batter hits the ball, it oscillates around its rest position and the batter swings again. Devices of this general type are shown in U.S. Pat. Nos. 1,554,409 and 3,475,026. Similar devices are shown in U.S. Pat. Nos. 708,573; 1,105,329; 2,247,072 and 4,138,107. It is this type device that this invention most nearly relates.

There are a variety of problems with the prior art devices of this type. In their simplest form, they are not much different than a T-ball support because the batter simply swings at it. They have an advantage over a T-ball because the ball ultimately returns to the hitting position rather than having to be retrieved. None of these prior art devices have the ability to adjust the position of the ball or contribute to the development of hand-eye coordination caused by movement of the ball immediately prior to or during the hitting stroke.

It is an object of this invention to provide an improved baseball batting practice device having a baseball-target suspended on a vertical elastic tensile element.

Another object of this invention is to provide an improved baseball batting practice device of this type having the ability to adjust the vertical position of the ball during the hitting stroke.

These and other objects of this invention will become more fully apparent as this description proceeds, reference being made to the accompanying drawing and appended claims.

IN THE DRAWINGS

Figure 1:
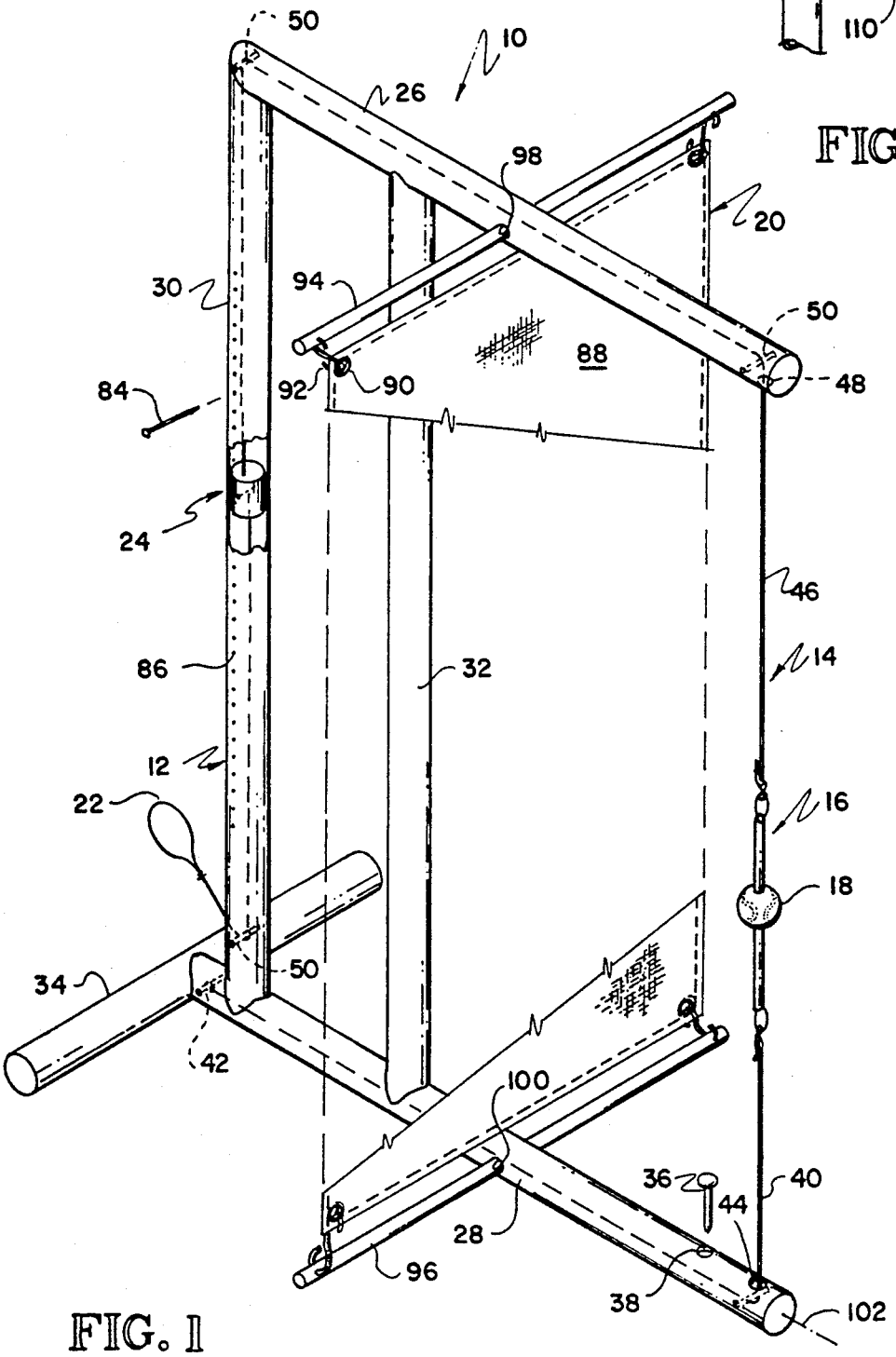
FIG. 1 is an isometric view of the baseball batting practice device of this invention.

Referring to FIG. 1, a baseball batting practice device 10 of this invention comprises, as major components, a support 12, an elongate tensile element 14 having a ball supporting assembly 16 therein including a baseball-like target 18, a screen 20, a handle 22 for moving the target 18 vertically and then releasing it and stop means 24 for stopping the target 18 at a predetermined vertical location.

The support 12 comprises a pair of horizontal members 26, 28 which are preferably hollow to receive the tensile member 14 therein. Thus, the horizontal members 26, 28 are preferably of pipe. A first vertical hollow member or pipe 30 connects the horizontal members 26, 28 and a second vertical member 32 parallel to the first member 30 provides bracing support. A horizontal member 34 extends across and connects to the horizontal member 28 to provide stability. Thus, the support 12 rests on an underlying ground surface. Additional stability may be provided by a stake 36 driven through an opening 38 in the horizontal member 28. As will be more fully apparent hereinafter, the support 12 may be made of PVC pipe or thin wall metal conduit.

The elongate tensile member 14 includes an elastic section 40 having one end connected to a pin 42 near the junction of the horizontal members 28, 34. Preferably, the elastic section 40 is of a bodily flexible material, such as surgical tubing or the like which extends through the horizontal member 28 and upwardly through an opening 44. In the alternative, the elastic section 40 may include an elongate relatively inelastic section and a spring connected to the pin 42. The elongate tensile member 14 also includes the ball support assembly 16 and an inelastic section 46 extending into an opening 48 in the underside of the horizontal member 26. The inelastic section 46 may comprise a braided rope and passes over a series of rollers 50 to terminate in a handle 22 comprising means for moving the target 18 vertically.

Figure 3:
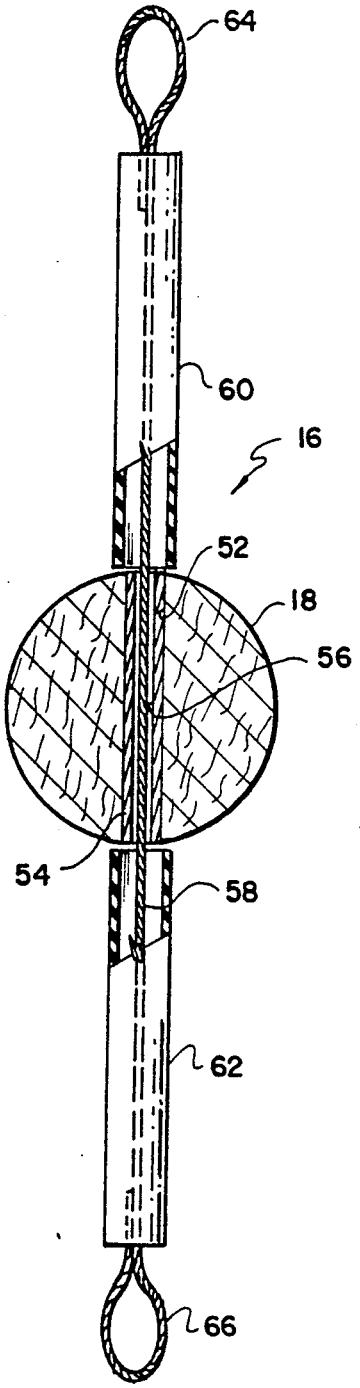
FIG. 3 is an enlarged view, partly in section, of the ball supporting assembly.

The ball support assembly 16 and baseball-like target 18 are shown best in FIG. 3. The target 18 preferably includes a conventional baseball which has been drilled to provide a central passage 52. A metal sleeve 54 is driven into the passage 52 and provides a smaller passage 56. The assembly 16 comprises a central braided wire rope 58 extending through the passage 56 and through upper and lower plastic tubing sections 60, 62. The ends of the wire rope 58 provide loops 64, 66 receiving the ends of the tensile element sections 40, 46. The plastic tubing sections 40, 46 protect the wire rope 58 from contact with the bat and accordingly promote long life of the device 10.

Figure 2:
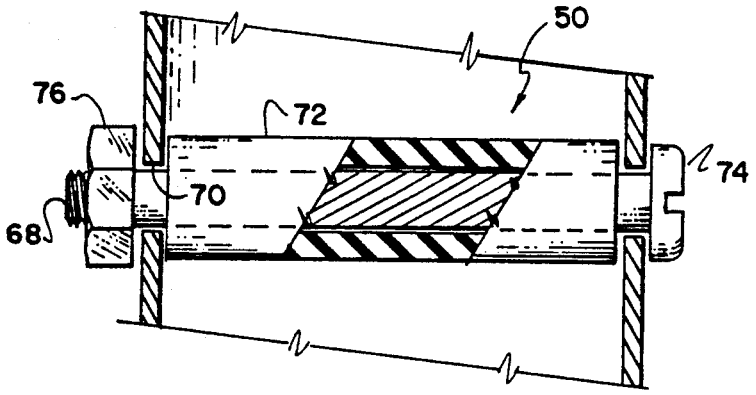
FIG. 2 is an enlarged view of one of the rollers incorporated in the device of FIG. 1.

The rollers 50 are best shown in FIG. 2 and comprise a bolt 68 extending through a pair of aligned openings 70 in the wall of the support 12. A plastic or hard rubber conduit section 72 rolls on the axle provided by the bolt 68 while the bolt head 74 and nut 76 captivate the bolt 68 in the openings 70.

Figure 4:
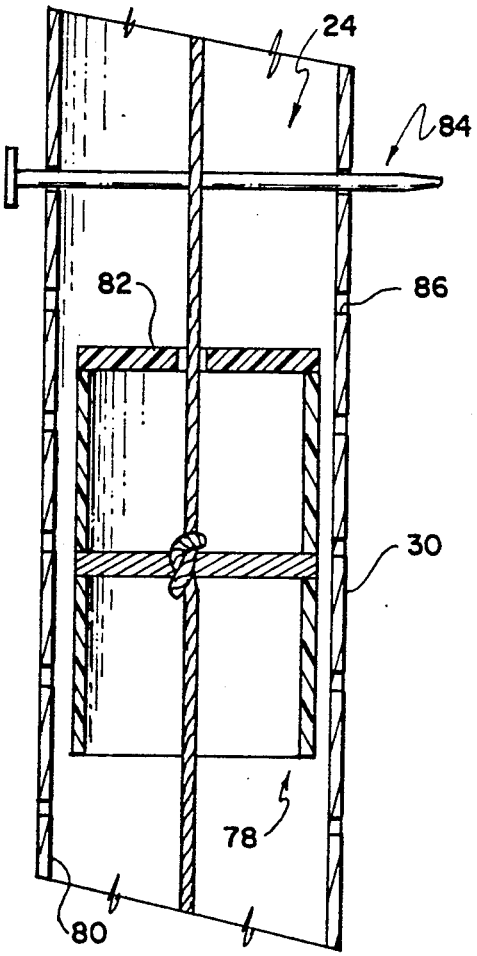
FIG. 4 is an enlarged cross-sectional view of the stop mechanism of this invention.

Referring to FIGS. 1 and 4, the stop means 24 is a more-or-less cylindrical block 78 loosely received inside the cylindrical passage 80 of the upright 30 and attached to the inelastic tensile section 46 for vertical sliding movement. The block 78 preferably includes a reinforced forward end 82 for contacting an abutment 84 placed in aligned pairs of openings 86 in the vertical upright 30. The abutment 84 may be of any suitable type, such as a pin or bolt. When a coach or other player pulls on the handle 22, the block 78 moves while the target 18 moves upwardly. When the coach releases the handle 22, the block 78 moves rapidly upward to contact the abutment 84 thereby stopping the target 18 at a predetermined vertical location. A series of aligned openings 86 are provided to adjust the vertical position of the target 18 as will be more fully apparent as this description proceeds.

The screen 20 is conveniently a canvass or plastic sheet 88 hemmed along the edges and providing metal eyes 90 at each corner. The sheet 88 is suspended by S-shaped hooks 92 between a pair of horizontal supports 94, 96 loosely received in openings 98, 100 in the horizontal support members 26, 28. The screen 20 is placed toward the support 32 a sufficient distance to be out of bat range. Preferably, the screen 20 is between the support 32 and the target 18 to absorb any ball impact and to partially hide the coach or other player who may be manipulating the handle 22 and abutment 84. Ball impact to the sheet 88 is absorbed by deformation of the sheet 88 and by movement of the supports 94, 96 in the openings 98, 100. Thus, the screen 20 protects the support 12 and the coach from being hit by the ball and also prevents the batter from seeing what the coach is doing about controlling the vertical position of the target 18.

Use of the baseball batting practice device 10 of this invention should now be apparent. Assembled as in FIG. 1, the batter stands near an extension of the axis 102 a comfortable distance from the target 18. The coach, partially hidden behind the screen 20, places the abutment 84 in a selected one of the aligned openings 86 and pulls on the handle 22. This raises the ball 18. The coach may indicate, in some way, to the batter that the ball is coming and then releases the handle 22. The target 18 rapidly moves toward the predetermined vertical position dictated by the abutment 84. Although the tensile element 14 may be strung in the support 12 to cause the target 18 to move upwardly, the illustrated approach is much preferred because movement of the baseball, in play, is predominantly down.

Figure 5:
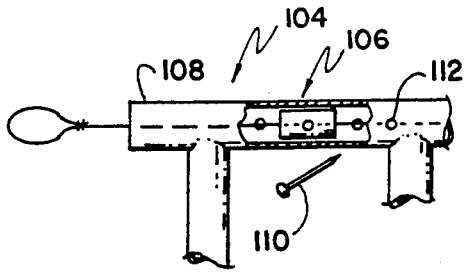
FIG. 5 is a partial view, partly in section, showing a slightly different version of this invention.

Referring to FIG. 5, another embodiment of this invention is illustrated. The baseball batting practice device 104 is identical to the device 10 except that the stop means 106 is located in the upper horizontal support 108 rather than in the vertical support member 30. In the device 104, the abutment 110 is inserted into one of the aligned openings 112 to control the vertical drop of the target.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A baseball batting practice device comprising a support having a vertical section and first and second horizontal vertically spaced members;

a baseball target;

a suspension means suspending the target between the horizontal members, said suspension means including an elongate elastic section having a first end affixed to the support, and a second end attached to one end of an elongate inelastic section, said inelastic section having a handle at its other end for pulling on the elastic section for moving the target away from the first horizontal member and thereby stressing the elastic section.

2. The baseball batting practice device of claim 1 further comprising stop means on said support, and means attached to said inelastic section for cooperating with the stop means for allowing the target to move away from a first predetermined target position and for preventing movement of the target toward the elastic section 1st end no closer than the first predetermined target position.

3. The baseball batting practice device of claim 2 wherein the stop means is located between the target and the handle.

4. The baseball batting practice device of claim 2 wherein the stop means is movable for adjusting the location of the first predetermined target position.

5. The baseball batting practice device of claim 2 wherein the stop means is positioned to allow movement of said target upwardly when the handle is pulled.

6. The baseball batting practice device of claim 2 wherein the vertical section and the first and second horizontal support members comprise conduits and said elastic section extends through said first horizontal members.

7. The baseball batting practice device of claim 2 wherein the vertical section and said horizontal members comprise(s) a conduit and said suspension member extends therethrough and the stop means comprises a block attached to said inelastic section and slidable inside the conduit and an abutment carried by the conduit for abutting the block and preventing movement thereof only in one direction when said target is at said first predetermined position.

8. The baseball batting practice device of claim 7 wherein said vertical section has a series of transverse vertically aligned opening pairs and the abutment comprises an elongate element extendable through a selected one of the aligned opening pairs.

9. The baseball batting practice device of claim 8 wherein the block is in the vertical section.

10. The baseball batting practice device of claim 8 wherein the block is in the 2nd horizontal member.

11. The baseball batting practice device of claim 1 wherein a vertical screen is attached to and suspended between said first and second horizontal members, said screen further being positioned between said target and said vertical section.

12. The baseball batting practice device of claim 11 wherein the first horizontal member provides a pair of aligned openings transverse to the first support, and further comprising a suspension means comprising a horizontal rod extending through the aligned openings, the vertical screen being supported on the horizontal rod.

* * * * *